US011356779B2

(12) United States Patent
Zhang

(10) Patent No.: US 11,356,779 B2
(45) Date of Patent: Jun. 7, 2022

(54) MULTI-ENGINE ARRAY SYSTEM AND LOUDSPEAKER

(71) Applicants: Yongchun Zhang, Heilongjiang (CN); Shenzhen Xinqi Science and Technology Co., Ltd., Shenzhen (CN)

(72) Inventor: Yongchun Zhang, Heilongjiang (CN)

(73) Assignee: Shenzhen Xinqi Science and Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/266,440

(22) PCT Filed: Aug. 6, 2019

(86) PCT No.: PCT/CN2019/099452
§ 371 (c)(1),
(2) Date: Feb. 5, 2021

(87) PCT Pub. No.: WO2020/029959
PCT Pub. Date: Feb. 13, 2020

(65) Prior Publication Data

US 2021/0297784 A1 Sep. 23, 2021

(30) Foreign Application Priority Data

Aug. 7, 2018 (CN) ..... 201810888625.4

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2400/11* (2013.01)

(58) Field of Classification Search
CPC combination set(s) only.
See application file for complete search history.

(56) References Cited

U.S. PATENT DOCUMENTS 7,864,977 B2 * 1/2011 Sadaie ..... H04R 1/227 381/407
2013/0051604 A1 2/2013 Sakai

FOREIGN PATENT DOCUMENTS

CN 101815233 A 8/2010
CN 202121767 U 1/2012
(Continued)

OTHER PUBLICATIONS

Extended European Search Report dated Aug. 31, 2021 received in European Patent Application No. EP 19848222.6.
(Continued)

*Primary Examiner* — Angelica M McKinney
(74) *Attorney, Agent, or Firm* — Scully Scott Murphy & Presser

(57) ABSTRACT

The present invention provides a multi-engine array system and a loudspeaker. The multi-engine array system comprises at least two engine assemblies; the at least two engine assemblies are mounted, in an array, at the bottom of a basin stand of a loudspeaker, each of the engine assemblies comprises a voice coil configured with a voice coil skeleton and a magnetic circuit system which provides a magnetic field for the voice coil, the magnetic circuit system comprising a magnetic bowl, a magnet and a magnetic conductive plate, the magnetic bowl being mounted at the bottom of the basin stand, the magnet and the magnetic conductive plate being located within the magnetic bowl, a magnetic gap being formed between the magnetic bowl, the magnet and the magnetic conductive plate, the voice coil being suspended in the magnetic gap, and cross sections of the voice coil and the magnetic circuit system both being rectangular. The present invention has a wide application range, is able to effectively reduce power consumption, improve efficiency of the loudspeaker, reduce resonance frequency and improve heat dissipation effects, and is able
(Continued)

to reduce various distortions such as nonlinear distortion by means of cooperation and restriction of multiple engine assemblies.

7 Claims, 6 Drawing Sheets

(56) References Cited

FOREIGN PATENT DOCUMENTS

| | | | | | |
|---|---|---|---|---|---|
| CN | 204559868 | U | | 8/2015 | |
| CN | 206100426 | U | | 4/2017 | |
| CN | 107360512 | A | | 11/2017 | |
| CN | 108966095 | A | | 12/2018 | |
| CN | 109068247 | A | | 12/2018 | |
| CN | 109195076 | A | | 1/2019 | |
| CN | 208489984 | U | | 2/2019 | |
| JP | S62-48898 | A | | 3/1987 | |
| JP | 2002300697 | A | * | 10/2002 | ..... H04R 31/00 |
| KR | 20100121771 | A | * | 11/2010 | |

OTHER PUBLICATIONS

International Search Report dated Oct. 29, 2019 received in International Application No. PCT/CN219/099452.

* cited by examiner

MULTI-ENGINE ARRAY SYSTEM AND LOUDSPEAKER

TECHNICAL FIELD

The present disclosure relates to the technical field of dynamic loudspeakers, in particular to a multi-engine array system and a loudspeaker.

BACKGROUND

Traditional loudspeakers are mostly driven by a single engine, and the shapes of the engines are mostly circular. In general, this kind of traditional engines are mostly of an external magnet type, consisting of upper and lower magnetic conduction plates (T iron and washer), magnets (mainly ferrites), voice coils (formed by winding a metal wire) and bobbins (handmade from DuPont fiberglass cloth, aluminum alloy roll or cardboard roll). For loudspeakers with a larger caliber, the traditional loudspeakers of a single-engine structure need to change the sizes of various components such as membrane and voice coils, especially the size and weight of the magnet in the engine; moreover, the cost, mold and the like make it difficult to achieve mass production of large-caliber loudspeakers.

In addition, poor engine heat dissipation will cause a series of problems with the loudspeakers, e.g., the magnet demagnetization phenomenon caused by heat, degumming, short circuit or destruction of the voice coil caused by heat, deformation of the voice coil bobbin or deformation of the membrane and a spider which contact the voice coil bobbin caused by heat, and power loss caused by heat, which will affect the efficiency $\eta_o$, etc.

There is only one voice coil in a single-engine loudspeaker, and its resistance $R_E$ is immutable except in the producing and processing stages in the voice coil factory. If the resistance $R_E$ is relatively large, a higher-power amplifier is required for driving, which has a large power consumption. The main source of heat in the loudspeaker is the voice coil. Although compressed air can also generate heat when the suspension system moves, this heat is negligible compared to the heat generated when the voice coil vibrates. The voice coil is a kind of resistant element with impedance and inductive reactance. After the current is supplied, in addition to the mechanical movement induced by the magnetic circuit, a part of the energy is also converted into thermal energy due to the resistant factor. According to the principle of energy conservation, this thermal energy of the voice coil is actually conversion and loss of part of the kinetic energy. In terms of temperature, in general, a transient temperature of the voice coil itself does not exceed 300° C., but in the case of persistent high power, a peak temperature can even exceed 300° C.; in addition, the temperature in the magnetic circuit is generally much lower than the voice coil itself, and will not exceed 100° C., but in extreme cases or in case of unreasonable heat dissipation, it can even approach or exceed 200° C. If the state of 200° C. or higher in the magnetic circuit lasts for a very long time, such as more than 30 minutes, the magnet with a lower coercive force will demagnetize, which will cause permanent loss of magnetic force. Therefore, sufficient heat dissipation is not only a necessary means to solve the demagnetization of magnet and the short circuit or destruction of the voice coil, but also enables the engine to convert as little thermal energy as possible and convert more kinetic energy during the electrical-force-acoustic conversion process, thereby reducing the loss caused during thermal energy conversion.

The voice coil in the traditional loudspeaker engine is similar to a cylinder and a piston of an engine when the voice coil moves in the magnetic circuit, which is a linear movement. However, this kind of movement of the voice coil in the magnetic circuit is not completely linear, but also exhibits nonlinearity. The nonlinearity mainly manifests in two aspects: first, since it is impossible for the height of magnetic gap to completely accommodate the height of the voice coil, a phenomenon that the voice coil exceeds the magnetic gap will occur, i.e., the maximum linear displacement $X_{Max}$ of the voice coil in the magnetic gap; when this happens, the linear movement thereof will not be as accurate as the piston in the cylinder, and approaching or exceeding this range will cause nonlinear movement and therefore generate nonlinear distortion and harmonic distortion; second, the voice coil, the voice coil bobbin as well as the spider and the membrane connected to the top of the voice coil bobbin are all in a semi-suspended state; at the same time, the spider and the membrane have elasticity, which will cause the voice coil to have a nonlinear deviation during the movement.

In addition, traditional single-engine loudspeakers will produce various distortion problems, such as harmonic distortion and intermodulation distortion caused by the nonlinear vibration of the voice coil beyond the magnetic gap, loss of output power and efficiency $\eta_o$ caused by the back electromotive force of the voice coil, nonlinear distortion caused by the uneven distribution of magnetic force of the engine and current BLI, as well as harmonic distortion, group delay, phase distortion and the like caused by the nonlinearity of the suspension system (including the membrane, the spider and a suspended part of a corrugated rim).

SUMMARY

An object of the present disclosure is to at least solve one of the above-mentioned defects and shortcomings, and the object is achieved through the following technical solutions.

The present disclosure provides a multi-engine array system including at least two engine assemblies installed in an array at a bottom of a basket of a loudspeaker, wherein each of the engine assemblies includes a voice coil equipped with a voice coil bobbin, and a magnetic circuit system for providing a magnetic field for the voice coil; the magnetic circuit system includes a magnetic cup, a magnet and a magnetic conduction plate, wherein the magnetic cup is installed at the bottom of the basket, the magnet and the magnetic conduction plate are located in the magnetic cup, a magnetic gap is formed between the magnetic cup and the magnet and the magnetic conduction plate, the voice coil is suspended in the magnetic gap, and the cross-sectional shapes of the voice coil and the magnetic circuit system are each rectangular.

Further, one end of the magnet is attached to a bottom of the magnetic cup, the other end of the magnet is attached to the magnetic conduction plate, and the magnetic gap is a ring-like magnetic gap.

Further, a bottom of the magnetic cup is provided with a plurality of first ventilation holes, positions of the first ventilation holes correspond to second ventilation holes provided at the bottom of the basket, and an internal air duct of the magnetic cup is formed between the magnetic gap and the first ventilation holes.

Further, the periphery of the cross section of the magnetic circuit system is in rounded corner transition.

Further, the magnetic circuit system is of an internal magnet structure, and the magnet is a strong neodymium-iron-boron magnet.

Further, the different voice coils of a plurality of the engine assemblies are connected to each other through a circuit, and the circuit connection of the plurality of voice coils includes a series-connection circuit, a parallel-connection circuit, and a comprehensive circuit combining series and parallel connections.

Further, the plurality of voice coils are respectively connected to a circuit board provided at a membrane bottom through voice coil lead wires, and the circuit board connects the plurality of voice coils to each other through the voice coil lead wires in the different circuit connections.

Further, the voice coil is wound around the periphery of the voice coil bobbin, and the voice coil includes a printed flexible circuit board or a single-side insulated metal foil strip.

Further, the voice coil bobbin is made of a high temperature resistant material which includes a high temperature resistant injection molding material or a lightweight ceramic material, and the voice coil bobbin is of an integral structure.

The present disclosure also provides a loudspeaker including the above multi-engine array system.

The present disclosure has the following advantages:

(1) The multi-engine array system of the present disclosure can be applied to loudspeakers of a larger size without relying on a high-power amplifier, which can effectively reduce power consumption and improve loudspeaker efficiency.

(2) The multi-engine array system of the present disclosure controls $Q_{ES}$, $Q_{MS}$ and $Q_{TS}$ reasonably by controlling impedance $R_E$ and inductive reactance $L_{VC}$, which can not only increase efficiency $\eta_o$, but also can reduce the resonant frequency $f_s$.

(3) The multi-engine array system of the present disclosure improves the heat dissipation effect by changing the structures of the voice coil and the voice coil bobbin, and at the same time, heat dissipation is achieved through the flow diversion and ventilation of the magnetic circuit, and sufficient heat dissipation is also achieved through the heat dissipation design of the loudspeaker basket.

(4) The multi-engine array system of the present disclosure makes the movement of the loudspeaker tend to be more linear, thereby reducing nonlinear distortion, and making the movement more balanced and stable, so that the response speed is faster, and the control ability is stronger; multiple engine assemblies work together and restrict each other, which can reduce various distortions and improve the acoustic performance of the loudspeaker.

(5) The present disclosure can perform high-power resolution on audio signals and in-depth restoration of dynamic details of the sound, and the spatial array distribution of the multiple engine assemblies enables complete diffusion of sound.

BRIEF DESCRIPTION OF THE DRAWINGS

Upon reading a detailed description of preferred embodiments below, various other advantages and benefits will become clear to those skilled in the art. The drawings are only used for the purpose of illustrating the preferred embodiments, and should not be considered as limiting the present disclosure. Throughout the drawings, identical parts are denoted by identical reference signs.

REFERENCE SIGNS

Figure 1:
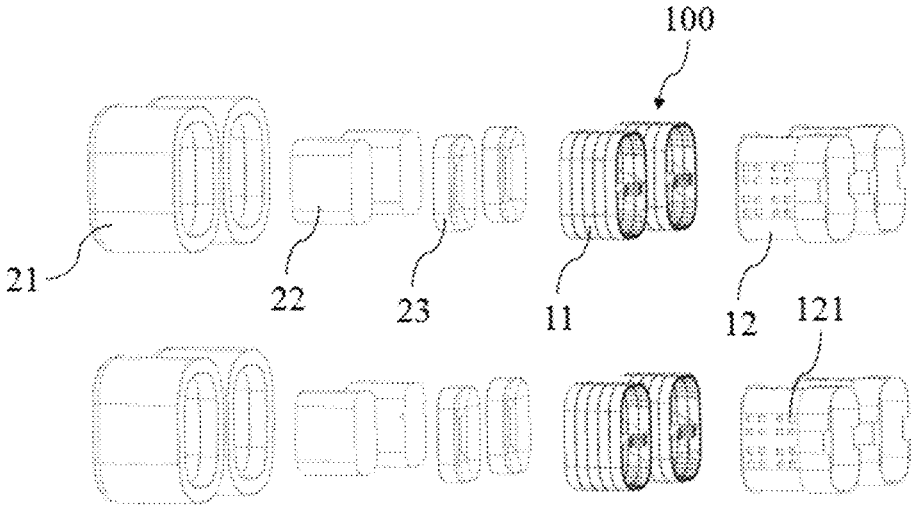
FIG. 1 is a schematic exploded view of a three-dimensional structure of a multi-engine array system provided by an embodiment of the present disclosure.

100: engine assembly;
200: basket;
300: membrane;
11: voice coil;
12: voice coil bobbin;
121: heat dissipation hole;
101: first voice coil;
102: second voice coil;
103: third voice coil;
104: fourth voice coil;
21: magnetic cup;
22: magnet;
23: magnetic conduction plate;
24: magnetic gap;
211: first ventilation hole;
31: membrane bottom;
311: circuit board;
201: second ventilation hole;
202: heat sink;
203: central air duct.

DETAILED DESCRIPTION

Hereinafter, exemplary embodiments of the present disclosure will be described in more detail with reference to the accompanying drawings. Although exemplary embodiments of the present disclosure are shown in the drawings, it should be understood that the present disclosure may be implemented in various forms and should not be limited by the embodiments set forth herein. On the contrary, these embodiments are provided to enable a more thorough understanding of the present disclosure and to fully convey the scope of the present disclosure to those skilled in the art.

First, the following terms will be explained to facilitate the understanding of the present application.

T/S parameters of a loudspeaker: T/S parameters perfected and established by Thiele and Small contain relatively complete theoretical data during the electrical-force-acoustic conversion process of the loudspeaker, and they are commonly accepted and adopted in the industrial design especially in the field of low-frequency direct radiating loudspeakers.

1. $Q_{ES}$, $Q_{MS}$ and $Q_{TS}$ in T/S parameters.

(1) $Q_{ES}$ refers to the electrical Q value at the resonant frequency of the loudspeaker unit, that is, a ratio of the DC resistance $R_E$ of the voice coil to the motional impedance at the resonant frequency fs. $Q_{ES}$ indicates the electrical quality of the voice coil itself, which is mainly exhibited as the DC resistance $R_E$, the inductance $L_{VC}$, and the electrical damping formed by the back electromotive force $R_{ES}$.

(2) $Q_{MS}$ refers to the mechanical Q value at the resonant frequency of the loudspeaker unit, that is, a ratio of the equivalent resistance of the mechanical loss impedance $R_{MS}$ of the unit support system to the motional impedance at the resonant frequency fs. $Q_{MS}$ indicates the mass of the voice coil itself and the mechanical resistance $R_{MS}$ of the suspension system (including the voice coil, a membrane, a spider and a suspended part of a corrugated rim).

(3) $Q_{TS}$ refers to the total Q value at the resonant frequency of the loudspeaker unit, that is, the parallel value of $Q_{ES}$ and $Q_{MS}$, wherein $Q_{TS}=(Q_{ES}\times Q_{MS})\div(Q_{ES}+Q_{MS})$.

It can be seen from the above formula that the lower the $Q_{ES}$ is, i.e., the smaller the electrical damping is, the higher the output power $N_o$ and the efficiency $\eta_o$ will be; reducing $Q_{ES}$ and $Q_{MS}$ can each effectively reduce $Q_{TS}$, but for the $Q_{MS}$, it is not that the lower the better; the $Q_{MS}$ being too low will cause underdamping so that the suspension system of the loudspeaker is too active and a delay will be caused, that is, the suspension system attenuates slowly after the signal stops, and still continues to vibrate according to the inertial force; the $Q_{MS}$ being too high will cause overdamping (excessive rigidity or excessive mass) so that the vibration of all vibration parts of the loudspeaker will be restricted, which will affect the efficiency $\eta_o$ and the resonant frequency $f_s$.

2. $X_{Max}$ refers to the maximum displacement of the voice coil in the magnetic gap. $X_{Max}$ is equal to a value obtained by dividing the difference between the height of the voice coil and the height of the magnetic gap by 2, and the value represents the range of movement of the movable part in one direction. Approaching or exceeding this range will cause nonlinear movement and generate harmonic distortion.

FIGS. 1 to 4 show schematic structural views of a multi-engine array system provided by an embodiment of the present disclosure. As shown in FIGS. 1 to 4, the multi-engine array system provided by the present disclosure includes at least two engine assemblies 100 installed at a bottom of a basket 200 of a loudspeaker and distributed in an array; wherein each of the engine assemblies 100 includes a voice coil 11 equipped with a voice coil bobbin 12, and a magnetic circuit system for providing a magnetic field for the voice coil 11; the magnetic circuit system includes a magnetic cup 21, a magnet 22 and a magnetic conduction plate 23, wherein the magnetic cup 21 is installed at the bottom of the basket 200, the magnet 22 and the magnetic conduction plate 23 are located in the magnetic cup 21, the magnetic conduction plate 23 is fixed to an end face of one end of the magnet 22, a magnetic gap 24 is formed between the magnetic 22 and the magnet cup 21, and the voice coil 11 is suspended in the magnetic gap 24; the cross-sectional shapes of the voice coil 11 and the magnetic circuit system are each rectangular so as to match loudspeakers of different basin-like structures, and the periphery of the cross section is in rounded corner transition. The above rectangular shape may be an oblong shape or a square shape. In addition, the shapes of the voice coil 11 and the magnetic circuit system of the engine assembly 100 may also be a circle or other shapes, to which the present disclosure does not impose any specific restrictions. The engine assemblies 100 with a rectangular rounded-corner structure that matches the shape of the basket 200 can not only achieve rapid assembly, but also can save installation space.

Figure 2:
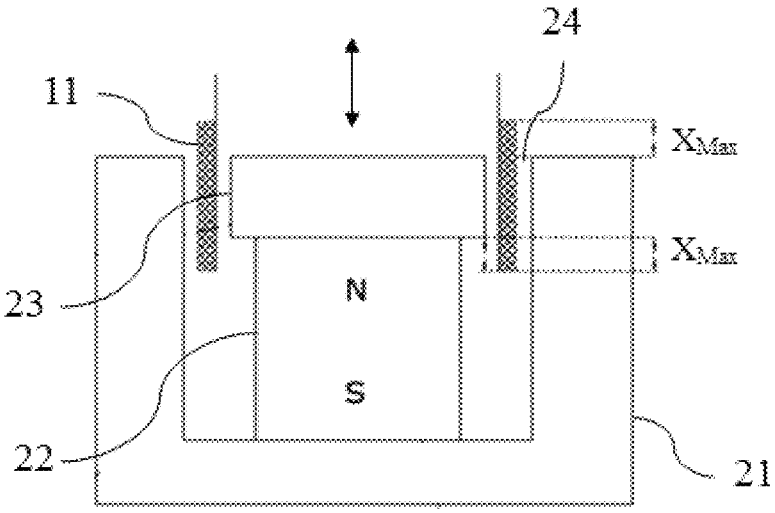
FIG. 2 is a schematic view of the operation of the multi-engine array system provided by the embodiment of the present disclosure.

Specifically, as shown in FIG. 2, the magnetic circuit assembly is of an internal magnet structure. As compared with an external magnet structure, the internal magnet structure has a small volume, occupies a small space, and can reduce magnetic leakage. One end of the magnet 22 is attached to a bottom of the magnetic cup 21, and the other end of the magnet 22 is attached to the magnetic conduction plate 23. The ring-like magnetic gap 24 is formed between the magnetic cup 21 and the magnet 22 and the magnetic conduction plate 23, and the voice coil 11 is suspended in the magnetic gap 24. When the current is applied, the voice coil 11 vibrates reciprocatively in the magnetic gap 24 in an axial direction of the magnet 22 and the magnetic conduction plate 23 (the directions of the double-headed arrow in the figure are the vibration direction of the voice coil 11). The maximum linear displacement of the voice coil 11 in the magnetic gap 24 is $X_{Max}$.

The magnet 22 is a strong neodymium-iron-boron magnet, which can provide a stronger magnetic field and provide greater power for the movement of the voice coil 11; in addition, the magnet 22 may also be made of other permanent magnet materials. The axial height of the magnetic gap 24 in the magnetic circuit system ranges from 4 mm to 8 mm, and the radial width of the magnetic gap 24 is 2 mm to 3 mm.

Figure 3:
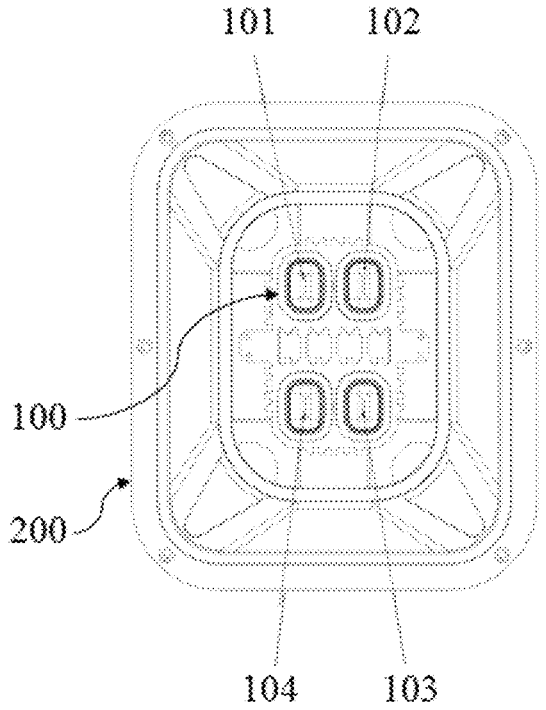
FIG. 3 is a schematic view of assembling the multi-engine array system provided by the embodiment of the present disclosure.
Figure 4:
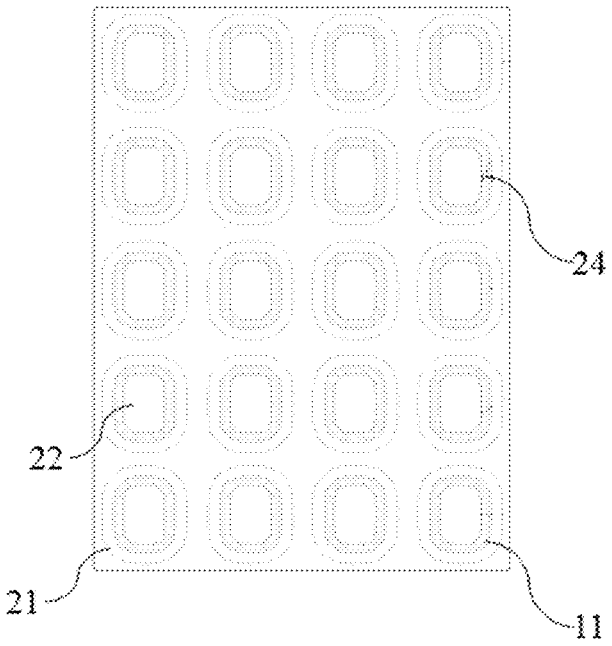
FIG. 4 is a schematic view of a multi-engine array system composed of 20 engines according to an embodiment of the present disclosure.

As shown in FIG. 3, a plurality of engine assemblies 100 are arranged in an array at the bottom of the basket 200. The number and size of the engine assemblies 100 are not specifically limited in the present disclosure, and may be set according to the caliber of the loudspeaker. For example, FIG. 4 shows a schematic view of a multi-engine array system composed of 20 engine assemblies. The multi-engine array system composed of a plurality of engine assemblies 100 has a wide range of applications, and can be applied to membranes with a large area and loudspeakers with a large caliber; the sizes of the independent engine assemblies 100 can be made smaller, so that they are separately suitable for loudspeakers with a small caliber; for loudspeakers with different caliber sizes and powers, only the number of engine assemblies 100 needs to be increased or decreased according to the size of the loudspeakers, without changing the size and specification of the engine assemblies 100.

The multi-engine array system composed of a plurality of engine assemblies 100 can reduce the power consumption of the loudspeaker and improve the efficiency. Taking four engine assemblies 100 as an example for specific description, the voice coils 11 of different engine assemblies 100 are connected to each other through a circuit. A separate series-connection circuit, a separate parallel-connection circuit, and a comprehensive circuit combining series and parallel connections may be used to obtain the ideal impedance $R_E$ target.

Figure 5:
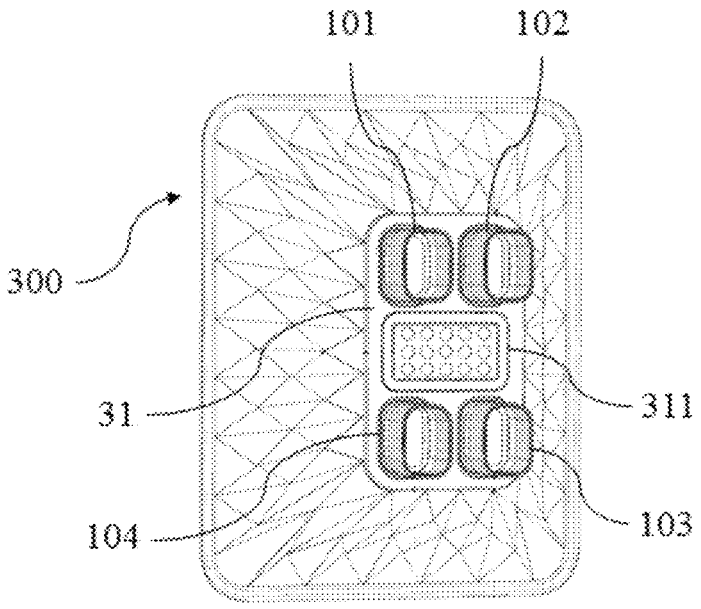
FIG. 5 is a schematic view of assembling a voice coil at a membrane bottom in the multi-engine array system provided by the embodiment of the present disclosure.

In a specific implementation, as shown in FIG. 5, different voice coils 11 are connected to each other through a dedicated circuit board 311 arranged on a membrane bottom 31. Each voice coil 11 is provided with a lead wire, and the voice coils 11 are connected to the circuit board 311 through the lead wires. Current is input to the voice coils 11 through the lead wires, and the wiring positions of the lead wires on the circuit board 311 can be adjusted to connect different voice coils 11 through different circuits.

Since the bottom of the membrane 300 is not firmly supported, and at the same time, if the membrane 300 is made of materials such as paper pulp, a paper bottom thereof is prone to deformation, a rigid base may be provided at the bottom of the membrane 300 in another embodiment so as to connect the voice coil 11 with the membrane 300 through the rigid base, thereby reducing the deformation of the membrane 300 and improving assembly efficiency. The rigid base matches the shape of the membrane bottom 31 and is bonded to the membrane bottom 31. The base is provided with a mounting part for connection with the voice coils 11, and the base is also provided with the circuit board 311 for connecting different voice coils 11 to each other. Each voice coil 11 is connected to the circuit board 311 through the lead wire, and different voice coils 11 can be connected to each other through the circuit by adjusting the wiring positions of the lead wires on the circuit board 311.

Figure 6:
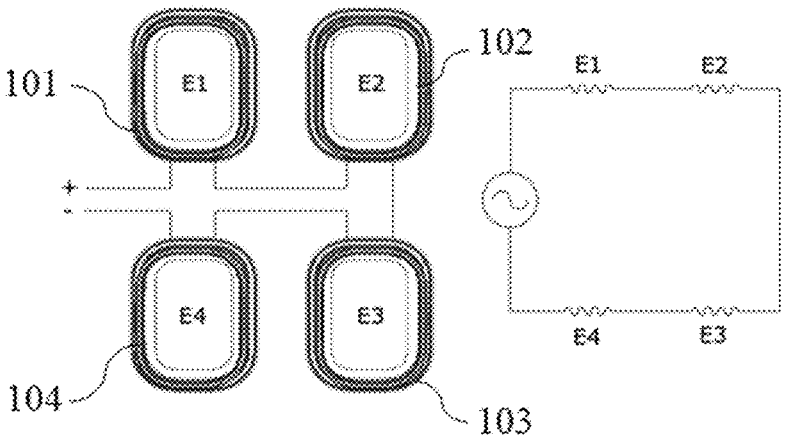
FIG. 6 is a schematic view of a series-connection circuit of a voice coil circuit provided by an embodiment of the present disclosure.
Figure 7:
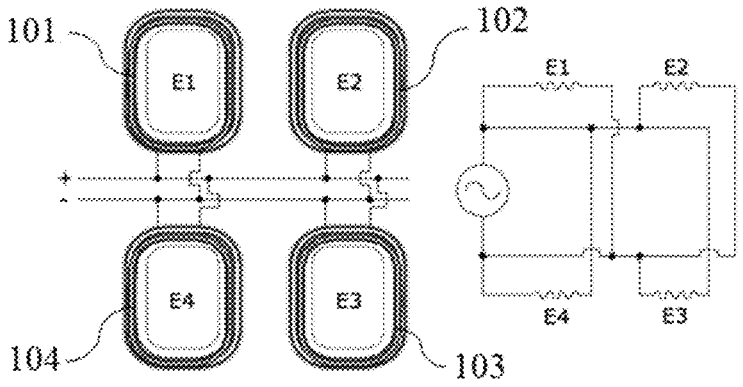
FIG. 7 is a schematic view of a parallel-connection circuit of a voice coil circuit provided by an embodiment of the present disclosure.
Figure 8:
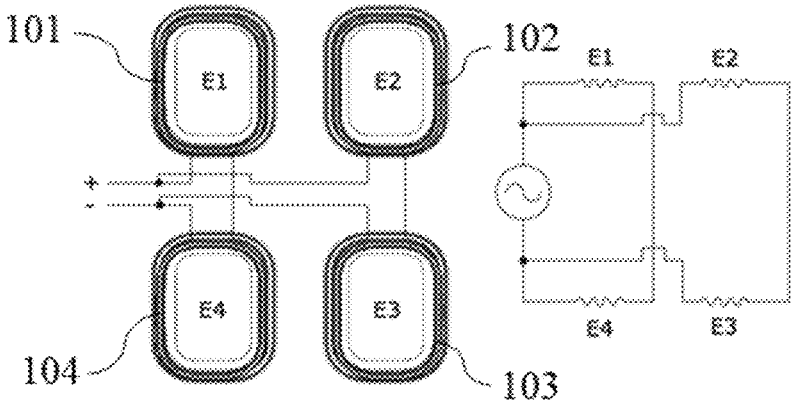
FIG. 8 is a schematic view of a series-parallel comprehensive circuit of a voice coil circuit provided by an embodiment of the present disclosure.

FIGS. 6 to 8 show schematic views of voice coil connection of a four-engine array system. As shown in FIGS. 6 to 8, assuming that the impedance $R_E$ of each voice coil 11 is 4Ω, there are three connection modes for different voice coil circuits: (1) series-connection mode: as shown in FIG. 6, four voice coils 11 are connected together in series through a series-connection circuit, and the final impedance $R_E=R_{E1}+R_{E2}+R_{E3}+R_{E4}=1\Omega$; (2) parallel-connection mode: as shown in FIG. 7, four voice coils 11 are connected together in parallel through a parallel-connection circuit, and the final impedance $R_E=1/(1/R_{E1}+1/R_{E2}+1/R_{E3}+1/R_{E4})=$; and (3) comprehensive mode, as shown in FIG. 8, four voice coils are divided into two groups, wherein the connection inside each group is series connection, and the groups are connected in parallel, or the connection inside each group is parallel connection, and the groups are connected in series; a first voice coil 101 and a fourth voice coil 104 are connected in series up and down, a second voice coil 102 and a third voice coil 103 are connected in series up and down, and the two groups of voice coils 11 connected in series up and down respectively are then connected in parallel left and right to obtain the final impedance $R_E=4\Omega$. It can be seen from the above that different voice coils 11 in the system can be freely combined through different circuit connections to obtain different impedances $R_E$. In addition, as the number of engine assemblies 100 increases, according to the principle of permutation and combination, more different impedances $R_E$ can be obtained through the comprehensive mode.

In other embodiments, assuming that the $R_E$ of each voice coil is 2Ω, the impedance $R_E$ that can be obtained through the series-connection mode is 8Ω, the impedance $R_E$ that can be obtained through the parallel-connection mode is 0.5Ω, and the impedance $R_E$ that can be obtained through the comprehensive mode is 2Ω; assuming that the $R_E$ of each voice coil is 6Ω, the impedance $R_E$ that can be obtained through the series-connection mode is 24Ω, the impedance $R_E$ that can be obtained through the parallel-connection mode is 1.5Ω, and the impedance $R_E$ that can be obtained through the comprehensive mode is 6Ω; assuming that the $R_E$ of each voice coil is 8Ω, the impedance $R_E$ that can be obtained through the series-connection mode is 32Ω, the impedance $R_E$ that can be obtained through the parallel-connection mode is 2Ω, and the impedance $R_E$ that can be obtained through the comprehensive mode is 8Ω.

It can be seen from the above circuit connections of the voice coils 11 that even if the loudspeaker size is large, the $R_E$ value can be changed to meet the impedance $R_E$ target by changing the circuit connections of multiple voice coils 11 and combining them according to Ohm's law; for example, for a case where the impedance $R_E$ of a single voice coil 11 is 16Ω, which is large, a small impedance of $R_E=4\Omega$ can be obtained by connecting four voice coils 11 in parallel. That is, the multi-engine array system composed of multiple engine assemblies 100 can control the impedance $R_E$ and the inductance $L_{VC}$ through a variety of freely connected voice coil circuits, thereby reducing $Q_{ES}$ and making it rational.

In addition, according to a formula $Q_{TS}=(Q_{ES}\times Q_{MS})\div(Q_{ES}+Q_{MS})$, it can be known that the change of any one of parameters $Q_{ES}$ and $Q_{MS}$ will affect $Q_{TS}$. In a case where $Q_{TS}$ is unchanged, effectively reducing the parameter value of $Q_{ES}$ will increase the parameter value of $Q_{MS}$. When the value of $Q_{MS}$ increases, the mass of the suspension system becomes greater, that is, the mass of the membrane 300 in the suspension system is allowed to be greater; if the unit mass is converted into a unit area, it can be seen that the area of the membrane 300 becomes larger. The increase in the mass and area of the membrane 300 results in more random air particles disturbed, resulting in a lower resonant frequency fs. Therefore, as the number of engine assemblies 100 increases, by reasonably controlling the impedance $R_E$ and the inductive reactance $L_{VC}$ to further affect $Q_{ES}$, $Q_{MS}$ and $Q_{TS}$, the resonant frequency fs can be reduced more and the acoustic performance can be improved.

Since the impedance $R_E$ of the loudspeaker of the multi-engine array system is controllable, the present disclosure does not need to rely on a high-power amplifier, which not only reduces power consumption, but also reduces power distortion caused by excessive power, and improves the efficiency $\eta_o$ of the loudspeaker.

Specifically, the efficiency $\eta_o$ of the loudspeaker is the percentage of acoustic-to-electrical conversion. The multi-engine array system reduces the dependence on the high-power amplifier, that is, the input power $N_I$ is reduced, and moreover, when multiple engine assemblies 100 perform work at the same time, the output power $N_O$ thereof is the superposition of independent work performed by multiple independent engine assemblies 100, so the total output power is increased. According to the efficiency formula: $\eta_o=N_O\div N_I\times 100\%$, the output power $N_O$ as the numerator increases, and the input power $N_I$ as the denominator decreases, so the total efficiency $\eta_o$ of the loudspeaker will be greatly increased.

In a preferred implementation, the voice coil 11 is formed by winding a printed flexible circuit board (FPC) or a single-side insulated metal foil strip. Specifically, the printed flexible circuit board (FPC) or the metal foil strip each is a strip-shaped monolithic body. When the printed flexible circuit board (FPC) is used, the flexible circuit board includes a conductive layer and an insulating layer. During the winding, one side of the insulating layer closely abuts the voice coil bobbin 12. In a specific implementation, the flexible circuit board may be provided with multiple longitudinal conductive layers (5 in this embodiment), and the multiple conductive layers are adhered to the insulating layer, and arranged tightly to wind around the periphery of the voice coil bobbin 12 to form the rectangular ring-like voice coil 11. When the metal foil strip is used, the insulating side of the metal foil strip closely abuts the voice coil bobbin 12. Since the voice coil 11 is formed by winding a thin strip-shaped sheet, the heat dissipation area is large, which can greatly improve the heat dissipation effect of the voice coil 11 and reduce the damage to the voice coil 11. The thin strip-shaped sheet can be wound on the voice coil bobbin 12 by several turns to increase the length of the voice coil. According to a formula F=BLI, when the length of voice coil increases, the ampere force (driving force) of the voice coil 11 increases, which can improve the sound conversion efficiency, where B is the average magnetic flux density inside the voice coil, L is the length of voice coil, and I is the current.

The voice coil bobbin 12 is made of a high-temperature resistant material and is integrally processed and formed. For example, high-temperature resistant injection molding materials or lightweight ceramic materials such as silicon nitride ($Si_3N_4$) and silicon carbide (SiC) can be used. These materials are light in weight and have good rigidity and good heat dissipation effect, and can realize the precise positioning of the voice coil 11 and reduce the error rate during assembly. The greater the number of voice coils 11 is, the more complicated the requirements for accurate positioning and the higher the accuracy requirements will be. Once the arrangement and position layout of the multiple voice coils 11 at the membrane bottom 31 are determined, the mapping (projection) position of the engine assembly 100 at the bottom of the basket 200 is determined, and an accurate assembling of the loudspeaker is realized. The precise positioning of the voice coils 11 can reduce the uneven distribution of magnetic force, reduce the damage to the voice coils 11 caused by collision with the magnetic circuit, and reduce the nonlinear movement of the voice coils 11. In addition, as shown in FIG. 2, a plurality of heat dissipation holes 121 distributed in an array are provided on a side wall of the voice coil bobbin 12, which can further increase the heat dissipation effect of the voice coils 11.

When the voice coil 11 is located in the middle of the magnetic field, the magnetic field strength is the highest, and the effective magnetic energy is concentrated in the magnetic gap 24. If the voice coil 11 exceeds the range of the magnetic gap 24, the magnetic field strength decreases rapidly. The maximum linear displacement $X_{Max}$ of the voice coil 11 in the magnetic gap 24 is the threshold of the linear movement of the voice coil 11. When the displacement of the voice coil 11 exceeds this limit, the length of the voice coil 11 that cuts the magnetic field decreases; in a case where the current in the voice coil 11 is unchanged, the ampere force received by the voice coil 11 will decrease, that is, the driving force of the voice coil 11 will decrease, and the output sound pressure of the loudspeaker will enter a nonlinear state, which is likely to cause obvious nonlinear distortion. Configuring the magnetic circuit system into a rectangular cylinder-like structure increases the maximum linear displacement $X_{Max}$ of the voice coil 11 in the magnetic gap and reduces distortion.

The multiple independent magnetic circuit systems and voice coils 11 in the multi-engine array system move at the same time and push the same membrane 300 connected thereto to vibrate. When the audio signal passes through the voice coils 11, it is not prone to polarization, which can effectively reduce the nonlinear deviation and make the movement of the loudspeaker tend to be more linear, thereby reducing nonlinear distortion; in addition, multiple voice coils 11 simultaneously push the membrane 300 to move; according to the principle of stability, the movement is made more balanced and stable, the reaction speed is faster, and the control ability is stronger.

When the audio current passes through the voice coils 11, the voice coils 11 are subject to force in the magnetic field, and the voice coils 11 drive the membrane 300 to reciprocate, thus causing the air to vibrate. The membrane 300 is displaced forward and backward by the perpendicular push of the voice coils 11. The larger the distance from the voice coils 11 to the edge of the membrane 300 (including the suspended part of the corrugated rim) is, the smaller the force directly and perpendicularly exerted by the voice coils 11 will be, and the greater the resulting nonlinear mechanical distortion will be, which further increases the amount of distortion and group delay; if the rigidity modulus of the membrane 300 is poor, the degree of distortion and group delay will be greater. Multiple voice coils 11 are used in the present multi-engine array system, and the arrangement of multiple voice coils 11 in an array greatly shortens the distance from the voice coils 11 to the edge of the membrane 300, thereby reducing the resulting distortion and group delay.

Multiple engine assemblies 100 work jointly, and multiple voice coils 11 thereof move jointly to push the same membrane 300 to move. At the same time, multiple engine assemblies 100 restrict each other, so the distortion of the loudspeaker is an average value of the distortion of the multiple engine assemblies 100. That is, $DE_S=(DE_1+DE_2+\ldots+DE_n)\div n$, where $DE_S$ is the distortion of the multi-engine array system, $DE_1$ is the distortion of the first engine assembly 101, $DE_2$ is the distortion of the second engine assembly 102, and n is the number of engine assemblies.

Multiple engine assemblies 100 work jointly and restrict each other, so that the frequency of distortion is greatly reduced. The aforementioned distortion includes: harmonic distortion and intermodulation distortion caused by the nonlinear vibration of the voice coil beyond the magnetic gap 24, loss of output power and efficiency $\eta_o$ caused by the back electromotive force of the voice coil, nonlinear distortion caused by the uneven distribution of magnetic force of the engine assemblies and current BLI, as well as harmonic distortion, group delay, phase distortion and the like caused by the nonlinearity of the suspension system (including the membrane 300, the spider and the suspended part of the corrugated rim).

Figure 9:
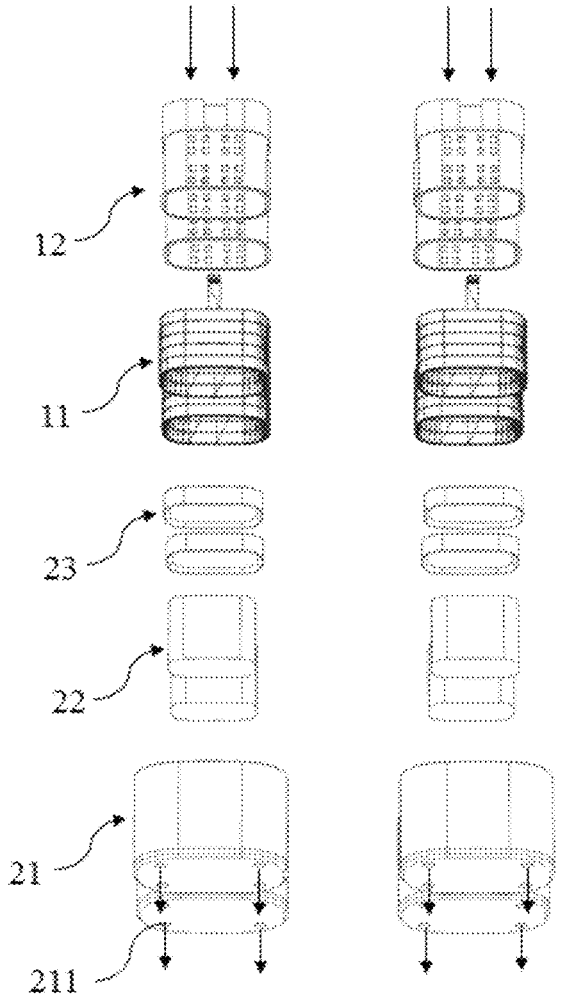
FIG. 9 is a schematic view of heat dissipation of the multi-engine array system provided by the embodiment of the present disclosure.

In order to reduce the power loss and efficiency loss caused by poor diffusion of heat accumulation, ventilation holes are provided at the bottom of the magnetic cup 21. As shown in FIG. 9, the arrow direction in the figure is the wind direction, and the bottom of the magnetic cup 21 is provided with four first Ventilation holes 211. The airflow coming from the membrane 300 and the spider and driven by the voice coils 11, after entering the magnetic circuit system, form an internal air duct of the magnetic cup 21 with the four first ventilation holes 211 at the bottom of each magnetic cup 21. Through the magnetic gap 24, the air flow is circulated to achieve the effects of flow diversion and ventilation. In a specific implementation, the provision of ventilation holes can reduce the heat in the magnetic circuit by about 20% and achieve a good heat dissipation effect.

Figure 10:
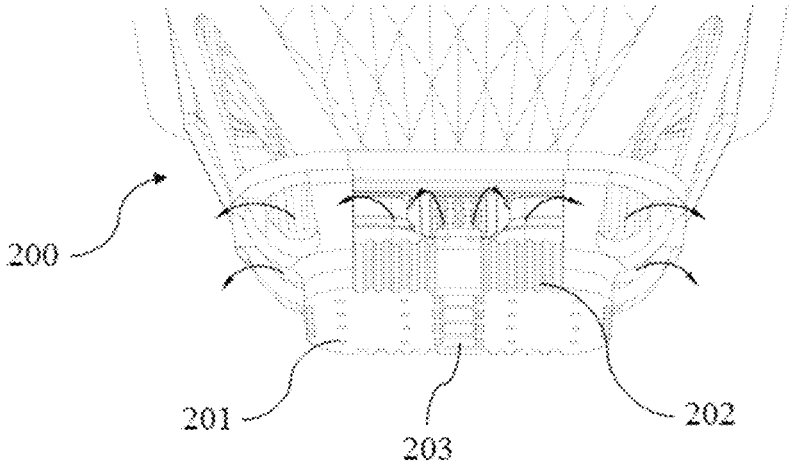
FIG. 10 is a schematic view of heat dissipation of a basket connected to the multi-engine array system provided by an embodiment of the present disclosure.

In addition, as shown in FIG. 10, second ventilation holes 201 are provided at the bottom of the basket 200. The second ventilation holes 201 are concentrically aligned with the positions of the first ventilation holes 211 of each magnetic cup 21 to ensure smooth airflow circulation of the entire system. Moreover, an open structure (shown by the curved arrows in the figure) is adopted for the basket 200 of the loudspeaker in the upper half of the engine, which can directly radiate the heat of a high-pressure zone formed in the engine to the surrounding low-pressure zone; a diffusion structure of the type of heat sinks 202 is also provided for the basket 200 at a lower half of the engine to enhance heat conduction and ensure that the heat of the magnetic cup 21 closely connected thereto can be released through thermal conduction. In addition, the bottom of the basket 200 is also provided with a central air duct 203, which can effectively reduce the direct stress when the membrane 300 vibrates and reduce the force resistance. The multi-engine array system realizes sufficient heat dissipation through the heat dissipation structure of the voice coil 11 itself, the magnetic circuit system, and the basket 200.

In cooperation with the membrane 300, the multi-engine array system can perform high-power resolution on audio signals and in-depth restoration of dynamic details of the sound, and the spatial array distribution of the multiple engine assemblies enables complete diffusion of sound. In the multi-engine array system, individual engine assemblies 100 are independent from each other, and all voice coil circuits between them are connected in parallel, in series or in a comprehensive mode. After receiving the same audio signal at the same time, all the voice coils 11 will perform linear piston-like movement at the same time to push the membrane 300 closely connected thereto to generate a series of complicated vibrations.

Figure 11:
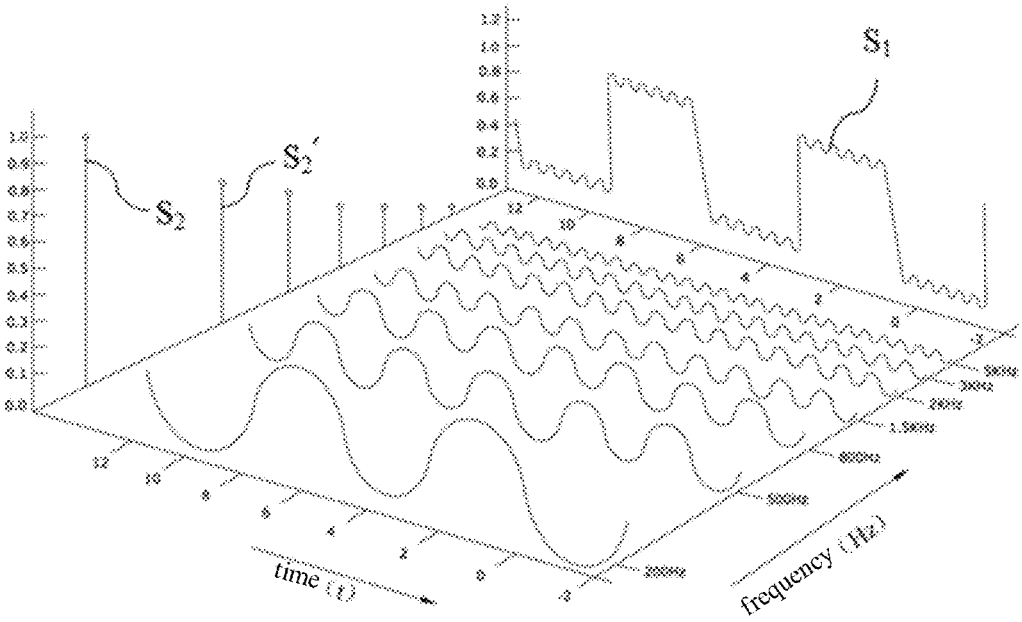
FIG. 11 is a schematic view of the Fourier transform of a sound wave provided by an embodiment of the present disclosure.

Specifically, multiple independent engine assemblies 100 coordinate and work together. Since the multi-engine array system of the present disclosure is of a distributed array mode composed of multiple independent engine assemblies 100, and different voice coils 11 adopt different circuit connections, according to the principle of Fourier transform, components of sound wave can be resolved or synthesized variously to obtain time-domain or frequency-domain images. The Fourier transform can resolve and split a complex wave (that is, many waves of different frequencies superimposed together) into simple waves (waves of a single frequency), and reversely synthesize simple waves into a complex wave. The more complex the signal is, the more the simple waves will be superimposed; and the simpler the signal is, the fewer the simple waves will be superimposed. Various simple waves can be used as signal components, such as sine waves, square waves, and sawtooth waves. The Fourier transform uses a sine wave as a signal component, which means that a certain function that satisfies certain conditions can be expressed as a sine or cosine function (trigonometric function) or a linear combination of their integrals. As shown in FIG. 11, a synthesized image $S_1$ of multiple simple waves of the sound wave in the time domain and multiple decomposed images $S_2$, $S_2'$ and the like of the sound wave in the frequency domain can be obtained after the Fourier transform.

The audio signals of the same channel are separated and superimposed for multiple times in fluctuation mode of frequency domain and time domain according to the principle of Fourier transform, and finally the electrical-force-acoustic conversion process is completed. The total sum of the cooperative work of multiple traditional single-engine loudspeakers is equivalently obtained. That is, the complete fluctuating state completed by multiple engines together can be expressed by the formula: $\Sigma E=E_1+E_2+ \ldots +E_n$ or $\Sigma E=E\times n$, where $\Sigma E$ is the sum of all the engines of the loudspeaker, E is a single engine assembly, and n is the number of engine assemblies. The use of the multi-engine array system can perform super resolution on sound waves, which can decompose or synthesize a complex audio signal for multiple times for resolution, so that colorful sounds can be resolved, thus achieving the ability of "high-power resolution on audio signals and in-depth restoration of dynamic details of the sound, and realizing complete diffusion of the spatial distribution of sound waves".

In another embodiment, the Shannon formula can be used to analyze the resolution of the loudspeaker. For ease of understanding, an equivalent analog is first made between the related terms of Shannon's information theory and the related terms of acoustics.

Channel: which can be analogous to the audio channel of the signal, that is, the audio signal (audio channel) connected into the circuit of the loudspeaker. Generally, only one audio signal is connected into one loudspeaker, and there is only one channel. The multiple engine assemblies 100 of the present application split the same channel into multiple channels with the same number of engine assemblies 100.

Bandwidth: which can be analogous to frequency width, that is, the difference between the highest frequency and the lowest frequency of the frequency components contained in the signal. The bandwidth is proportional to the capacity, has a unit of Hz, and is represented by H in the formula.

Velocity: which can be analogous to the ratio of the wavelength $\lambda$ through which the particle displacement passes and the time t of passing through this wavelength $\lambda$, wherein $v=\lambda/t$. The velocity is not equal to speed, but is proportional to speed. The frequency of the sound wave is determined by the sound source that produces the sound, and does not change with the change of the medium in which the sound is propagated. Therefore, the sound waves of different frequencies have different propagation velocities in the same medium. The lower the frequency is, the larger the wavelength and the larger the velocity will be; and the higher the frequency is, the smaller the wavelength and the smaller the velocity will be. In acoustics, the velocity is more affected by the low frequency end of the bandwidth.

Error rate: which can be equivalent to distortion rate.

The Shannon formula $C=H \log_2(1+S/N)$ shows that the information capacity C is directly proportional to the channel, the bandwidth H, and the velocity v, but the error rate is inversely proportional to the information capacity C, the channel, and the bandwidth H, and is directly proportional to the velocity v. S/N is the signal-to-noise ratio, wherein S is the signal power (watts), and N is the noise power (watts); the information capacity C is the maximum transmission capacity of the channel That is, if the information source velocity R of the channel is less than or equal to the channel capacity C, then theoretically, the output of the information source can be transmitted through the channel with an arbitrarily small error rate.

In this embodiment, the velocity v is equivalent to the ratio of the wavelength $\lambda$ to the time t, the channel capacity C is equivalent to the frequency width H, and the error rate is equivalent to the distortion rate (DR); in order to reduce the distortion, the frequency width H can be increased or the velocity v can be reduced. If the frequency width H and the velocity v increase at the same time or only one of them increases, the amount of information passing through the channel will also inevitably increase; and if the frequency width H decreases at the same time or only one of them decreases, the amount of information passing through the channel will also inevitably decrease. When the number of channels is greater than or equal to 2, the overall amount of information and the channels are also superimposed in an array.

According to the Shannon formula, the total information capacity can be expressed as $\Sigma C=H \log_2(1+S/N)\times cn$, where $\Sigma C$ is the sum of the information passing through all the channels, H is the frequency width, and the lowercase cn is the number of channels superimposed in an array. If the signal-to-noise ratio S/N is ignored, the formula can be simplified as $\Sigma C=H\times cn$, that is, the sum of the information passing through all the channels is equal to the bandwidth multiplied by the number of channels. This formula can be completely equivalent to the general formula in the Fourier analysis above: "$\Sigma E=E_1+E_2+\ldots+E_n$, or $\Sigma E=E\times n$", that is, the sum of all engines is equal to the superposition or multiplication of individual engines.

The resolution of the loudspeaker using the Shannon formula shows that the use of the multi-engine array system makes the total amount of information C and the frequency width H of the loudspeaker controllable, which can improve the ability of resolving the audio signals of the loudspeaker and the ability of controlling the loudspeaker.

In another embodiment, the resolution of the loudspeaker is analyzed in the way of equivalent circuit modeling, and lumped parameters of the electrical-force-acoustic conversion process are integrated in the way of circuit model to form an equivalent circuit model. In this way, mechanical (force) and acoustic (sound) parameters can be converted into electrical (electricity) parameters, which are displayed and calculated in the form of reactance in the circuit. The reactance includes resistance $R_E$ (impedance), capacitance $C_{AP}$ (capacitive reactance), and inductance $L_{VC}$ (inductive reactance). As shown in FIGS. 6 to 8, the multi-engine array system has multiple engine assemblies 100, and circuits of the voice coils 11 of different engine assemblies 100 can form multiple groups of equivalent circuits after effective combination. The multiple groups of equivalent circuits can perform various resolutions on the audio signals, improve the ability of high-power resolution on the original audio signals, and improve the performance of the loudspeaker.

In the multi-engine array system provided by the present disclosure, individual engine assemblies are independent from each other, and they unite to jointly push the same rectangular basin-like membrane closely connected thereto to vibrate. The membrane converts the electrical energy generated by the signals in the engines into the mechanical energy, and through resolutions of the above Fourier transform, the Shannon theory, the equivalent circuit modeling and the like, colorful sounds can be resolved, thereby achieving high-power resolution on audio signals, in-depth restoration of dynamic details of the sound, and complete diffusion of the spatial distribution of sound waves.

The present disclosure also provides a loudspeaker including the above multi-engine array system.

The present disclosure can be applied to loudspeakers of a larger caliber without relying on a high-power amplifier, which can effectively reduce power consumption and improve loudspeaker efficiency. The multi-engine array system controls $Q_{ES}$, $Q_{MS}$ and $Q_{TS}$ reasonably by controlling impedance $R_E$ and inductive reactance $L_{VC}$, which can not only increase efficiency $\eta_o$, but also can reduce the resonant frequency $f_s$. The multi-engine array system improves the heat dissipation effect by changing the structures of the voice coil and the voice coil bobbin, and at the same time, heat dissipation is achieved through the flow diversion and ventilation of the magnetic circuit, and sufficient heat dissipation is also achieved through the heat dissipation design of the loudspeaker basket. The multi-engine array system makes the movement of the loudspeaker tend to be more linear, thereby reducing nonlinear distortion, and making the movement more balanced and stable, so that the response speed is faster, and the control ability is stronger; multiple engine assemblies work together and restrict each other, which can reduce various distortions and improve the acoustic performance of the loudspeaker.

It should be pointed out that in the description of the present disclosure, terms "first" and "second" are only used to distinguish one entity or operation from another entity or operation, and it is not necessarily required or implied that there is any such actual relationship or order between these entities or operations.

Described above are only specific embodiments of the present disclosure, but the scope of protection of the present disclosure is not limited to this. Any change or replacement that can be easily conceived by those skilled in the art within the technical scope disclosed in this document should be covered within the scope of protection of the present disclosure. Therefore, the scope of protection of the present disclosure shall be accorded with the scope of the claims.

The invention claimed is:

1. A multi-engine array system comprising:

at least two engine assemblies installed in an array at a bottom of a basket of a loudspeaker, wherein:

each of the engine assemblies comprises a voice coil equipped with a voice coil bobbin, and a magnetic circuit system for providing a magnetic field for the voice coil;

the voice coil is wound around a periphery of the voice coil bobbin, and the voice coil is formed by winding a printed flexible circuit board or a single-side insulated metal foil strip; and the magnetic circuit system comprises a magnetic cup, a magnet and a magnetic conduction plate, and a periphery of a cross section of the magnetic circuit system is in rounded corner transition, wherein the magnetic cup is installed at the bottom of the basket, the magnet and the magnetic conduction plate are located in the magnetic cup, a magnetic gap is formed between the magnetic cup and the magnet and the magnetic conduction plate, the voice coil is suspended in the magnetic gap, and cross-sectional shapes of the voice coil and the magnetic circuit system are each rectangular, the different voice coils of a plurality of the engine assemblies are connected to each other through a circuit, and the circuit connection of the plurality of voice coils comprises a series-connection circuit, a parallel-connection circuit, and a comprehensive circuit combining series and parallel connections.

2. The multi-engine array system according to claim 1, wherein one end of the magnet is attached to a bottom of the magnetic cup, another end of the magnet is attached to the magnetic conduction plate, and the magnetic gap is a ring-like magnetic gap.

3. The multi-engine array system according to claim 1, wherein a bottom of the magnetic cup is provided with a plurality of first ventilation holes, positions of the first ventilation holes correspond to second ventilation holes provided at the bottom of the basket, and an internal air duct of the magnetic cup is formed between the magnetic gap and the first ventilation holes.

4. The multi-engine array system according to claim 1, wherein the magnetic circuit system is of an internal magnet structure, and the magnet is a strong neodymium-iron-boron magnet.

5. The multi-engine array system according to claim 1, wherein the plurality of voice coils are respectively connected to a circuit board provided at a membrane bottom through voice coil lead wires, and the circuit board connects the plurality of voice coils to each other through the voice coil lead wires in the different circuit connections.

6. The multi-engine array system according to claim 1, wherein the voice coil bobbin is made of a high temperature resistant material which comprises a high temperature resistant injection molding material or a lightweight ceramic material, and the voice coil bobbin is of an integral structure.

7. A loudspeaker comprising the multi-engine array system according to claim 1.

* * * * *